United States Patent [19]

Seragnoli

[11] 4,092,816

[45] June 6, 1978

[54] INNER FOIL WRAPPING DEVICE

[75] Inventor: Enzo Seragnoli, Bologna, Italy

[73] Assignee: G. D. Società Per Azioni, Bologna, Italy

[21] Appl. No.: 781,525

[22] Filed: Mar. 25, 1977

[30] Foreign Application Priority Data

Mar. 31, 1976 Italy ..... 3389A/76

[51] Int. Cl.[2] ..... B65B 11/32

[52] U.S. Cl. ..... 53/234

[58] Field of Search ..... 53/234, 225

[56] References Cited

U.S. PATENT DOCUMENTS

| | | | |
|---|---|---|---|
| 3,385,176 | 5/1968 | Whitaker | 53/234 X |
| 3,924,386 | 12/1975 | Schmermund | 53/234 X |

*Primary Examiner*—Travis S. McGehee

*Attorney, Agent, or Firm*—Browdy and Neimark

[57] ABSTRACT

A device to put the inner foil wrapper on soft packets in a very high speed cigarette packer comprises a head or wheel turning at intervals fitted with a number of radiating compartments capable of taking at most one bundle of cigarettes for packeting and a plurality of folding mechanisms including a folder with alternating movement.

The wall of each compartment above the folder with alternating movement in the sense of rotation of the turning head or wheel comprises a thin plate. The folder with alternating movement carries a second thin plate towards the turning head or wheel so as to rebut during its forward movement the after end of the length of foil onto the surface of the former plate external to the corresponding compartment.

2 Claims, 5 Drawing Figures

INNER FOIL WRAPPING DEVICE

FIELD OF THE INVENTION

The present invention concerns devices for inner foil wrapping soft or American type packets in cigarette packing machines and more particularly a device capable of laying the length of the foil's long ends over one of the larger faces of the bundle of cigarettes.

BACKGROUND OF THE INVENTION

As is widely known, the wrapping elements that make up a soft packet are the inner foil wrap, the outer wrap or label of paper or cardboard, and lastly the State seal or paper seal. The inner wrapper from a rectangular length of foil is put tube-wise around the four faces of the bundle of cigarettes longways with the long ends overlapping parallel to the lie of the cigarettes. The ends of the cigarettes or head ends of the bundle are then covered by rebutting onto them the length's opposite ends protruding from the said faces. The technical term "soap type" wrapper describes this kind of layer.

The outer wrap in a similar manner is put over the inner wrap except at one of the two head ends.

The State seal is then applied crossways to close this outer wrap free head.

It is also known how smokers open soft or American type packets by tearing off from the top of the packet free of the outer label one of the two portions of the inner wrapper comprised between the State seal and the corresponding head end.

FIGS. 1 and 2 both show part of a known soft type cigarette packet at this top end and thus the two portions on the right and left of the State seal one or the other of which is going to be removed when the packet is opened. Note that these figures make particularly clear by removing part of the outer wrapper that in the first case (FIG. 1) the inner wrapper ends lie over one of the larger faces of the packet whereas in the second case (FIG. 2) the inner wrap ends lie over one of the smaller or side faces of the packet.

Inner wrappers made either as shown in FIG. 1 or in FIG. 2 are used in making up soft type cigarette packets. The inner wrap of the first type is used in particular in the usual packers running at a production speed of 120–140 packets per minute.

The inner wrap of the second type is made in turn on soft packet cigarette packers operating at very high production speeds (400 packets per minute) trade named X1 and described for example in applicant's U.S. Pat. Nos. 3,628,309 and 3,948,115 and application Ser. No. 611,885.

In the inner wrap portion comprised between the State seal and the head end top right, the overlap zone of the inner wrap long ends presents its after end crossways to the head next the State seal in the case of FIG. 1 whereas this zone occurs longways-on to the head in the case of FIG. 2.

It is evident that to open the packet by removing the wrap portion comprising the end part of the said overlap zone (case considered for the present as found to be the commonest), this operation is very simply performed for a packet of the type shown in FIG. 1 by breaking the inner wrapper along the line of this portion in the sense indicated by arrow f1 whereas for a packet of the type shown in FIG. 2 owing to the subdivision into two parts of the portion for removal the same operation calls for two succeeding phases first tearing the wrapper in the sense of arrow f2 and then in that of arrow f3.

SUMMARY OF THE INVENTION

It is a purpose of the present invention, given the ease of packet opening with the inner wrap type represented in FIG. 1, to make a device for a very high speed soft packet cigarette packer capable of getting an inner wrapper to present the overlap zone of the length of the foil's long ends on one of the larger faces of the bundle of cigarettes.

According to a vital feature in mark XI very high speed machines (described for example in the patents cited above) the inner wrap is made by interposing fixed or moving rigid means successively between the folder elements and bundle of cigarettes with the twofold function of protecting the cigarettes and ensuring a faultless fold. It is a further purpose of the present invention to provide the feature in the mark XI machines protecting the cigarettes and ensuring a faultless fold.

It is a further purpose of the present invention to make a particularly simple and economical device.

These and still other purposes are all fulfilled in the device of the present invention for putting the inner foil wrapper with the length's long ends over one of the larger faces of the bundle of cigarettes. A very high speed soft packet cigarette packer comprises a head or wheel turning at intervals fitted with a number of radiating compartments at equal distances from one another capable of taking a bundle of cigarettes for packeting laid long sides onto the axis of rotation of the said turning head or wheel. A number of fixed and moving folder mechanisms operate in combination with the same turning head or wheel for packeting operations with the length of foil, one of the folder mechanisms with alternating radial movement, and tangential to the peripheral fascia of the turning head or wheel corresponding to a stay position held by succeeding compartments of the turning head or wheel. The wall of each compartment above the folder with alternating movement in the sense of rotation of the turning head or wheel comprises a thin plate. The folder with alternating movement also has a thin plate towards the turning head or wheel so as to rebut during its forward movement the after end of the length of foil onto the surface of the former plate external to the corresponding compartment.

BRIEF DESCRIPTION OF THE DRAWINGS

Further features and advantages will become plainer in the detailed description that follows of a preferred but not exclusive embodiment of the present invention which is described with reference to the annexed diagrams in which.

DETAILED DESCRIPTION OF THE PREFERRED EMBODIMENT

Figure 3:
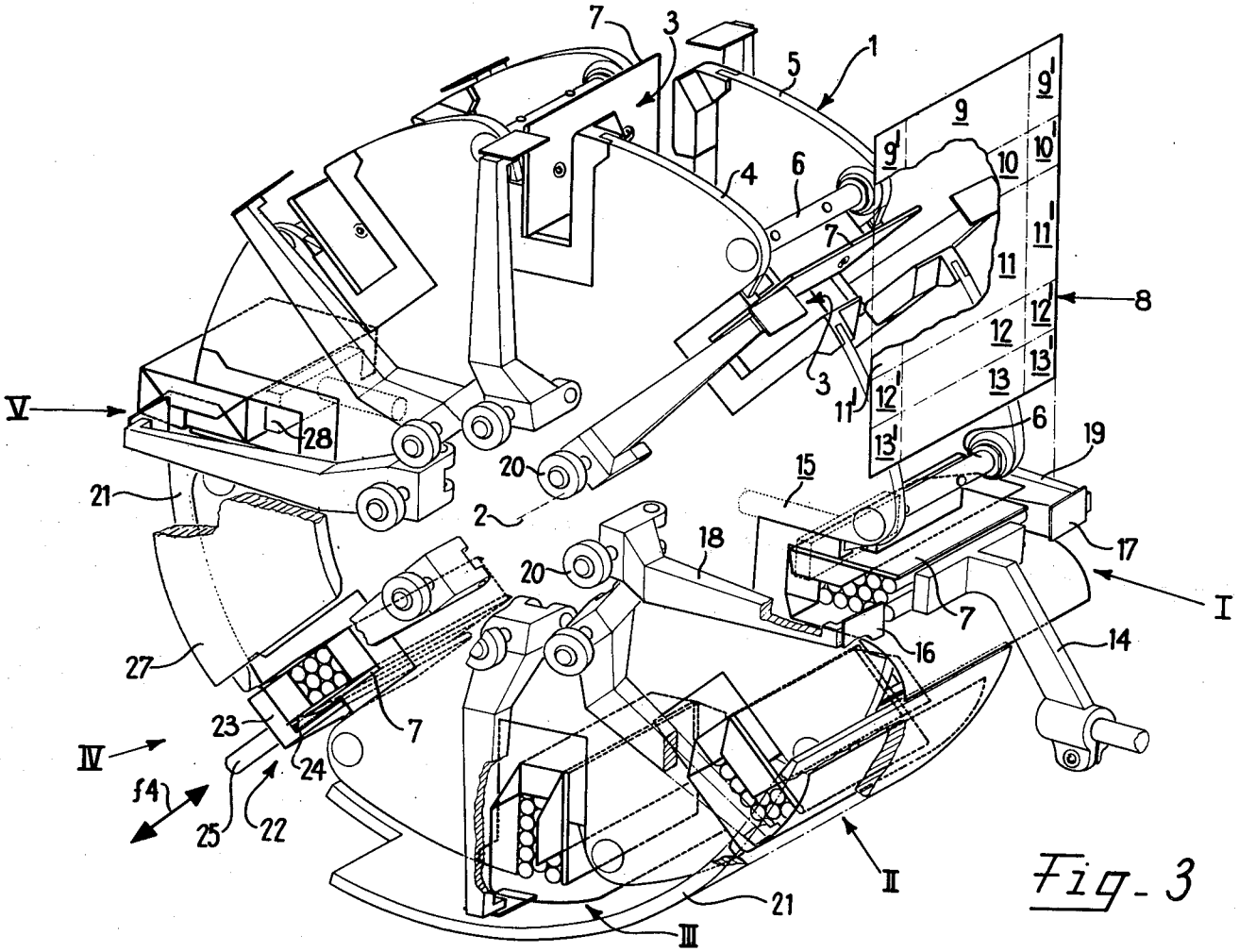
FIG. 3 shows in perspective and partly in section, part of a soft packet cigarette packer comprising the device of the present invention

With particular reference to FIG. 3 a head 1 of cylindrical structure turning at intervals clockwise with 45° rotation at each turn is mounted on a horizontal axle 2 having eight radiating compartments 3 at the periphery set at 45° to one another.

This turning head 1 comprises basically two coaxial discs 4, 5 set one to the other at a distance equal to the length of a cigarette and made rigid by small bars 6 parallel to the axis of rotation 2. The head 1 is the first wrap station in a packer of the type described in applicant's U.S. Pat. No. 3,948,115 and application Ser. No. 611,885 cited above, that is the station corresponding to which the bundles of cigarettes are given the inner foil wrapper.

The radiating compartments 3 formed by cutting into the body of the turning head 1 are such as to hold parallel sided shapes of the dimensions of the bundles of cigarettes laid long side-on to the axis of rotation 2.

These compartments 3 have the feed-in on the cylindrical contour of the turning head and are open at the two long ends and corresponding to the back face, given the direction of movement, carry a rectangular plate 7 the particular functions of which will follow.

Along a vertical plane on the right of turning head 1 as you look at FIG. 3, rectangular lengths 8 of foil are fed in the usual manner.

With a view to simplifying the description that follows these lengths 8 are subdivided by dotted lines indicating theoretical folds into the various zones or panels which go to make up the various faces of the inner wrapper. These panels are marked from top to bottom by numbers 9, 10, 11, 12 and 13 while the same numbers with a prime mark indicate the two ends or wings of each of the panels which go to make up as will be shown the two head ends of the inner wrapper.

Compartments 3 come to rest in succession corresponding to the feed-in position I.

As known from the two patents cited above, transferring a bundle of cigarettes with forward movement transverse to the axes of the same and a length 8 of wrapping material into the compartment placed corresponding to this position I is effected by means of pusher 14 in combination with counter pusher 15 both mounted on horizontal spindles with alternating movement radial to the turning head. Counter pusher 15 on its forward course (see FIG. 3) then comes up against a length of foil 8 in place next to position I, bringing panel 10 to adhere to the left side of the bundle of cigarettes.

On putting the bundle of cigarettes into compartment 3 the two panels 9 and 11 are made to fold back progressively on the layers of cigarettes above and below.

When this operation is done while counter pusher 15 moves off slightly from panel 10 pusher 14 begins its return course.

Containing the cigarettes in compartment 3 at this point is ensured by means of rectangular platelets 16 and 17 moved together to contact the two long ends of the outer side of the bundle of cigarettes.

These platelets 16 and 17 are joined to the ends respectively of arms 18 and 19 oscillating in the same radial plane round the fulcrums joined to discs 4 and 5. These arms which every compartment carries go to form two symmetrical systems in respect of turning head 1.

Near their fulcrums these arms 18 and 19 are fitted with idlers 20 by which means, using cams not shown in the figures and described in the two patents cited above, they get their oscillating movement up to and away from the relative compartment 3.

After platelets 16 and 17 have acted, with compartment 3 still in place in position I, through means known and described in the patents cited above the folding operation is performed on the two wings 10' against the two head ends of the bundle of cigarettes.

Turning head 1 begins at this point its revolving movement clockwise with consequent transfer of compartment 3 to a position II placed as said at 45° to feed-in position I.

During the course of this transfer the folding takes place of that part of the length comprising panels 12 and 13 protruding from the forward face of the compartment given the sense of movement.

This folding, performed by the fixed guide or guard 21 concentric to turning head 1 and adhering to its contour from this zone to a feed-out position of the bundle of cigarettes, brings panel 12 to adhere to the outer side of the bundle of cigarettes.

In this phase as known the two platelets 16 and 17 act as elements of contrast to the action of fixed guide 21 saving any damage to the cigarettes and also producing a perfect corner between panels 11 and 12.

In the course of compartment 3 transfer from position II to a position III set at 90° to feed-in position I the above mentioned arrangement of cams makes arms 18 and 19 open with the result that platelets 16 and 17 move off from panel 12.

Any displacement of the bundle of cigarettes partly wrapped in length 8 relative to compartment 3 is prevented by fixed guide 21.

Compartment 3 is then transferred to a position IV corresponding to which fixed guide 21 presents an interruption.

Figure 1:
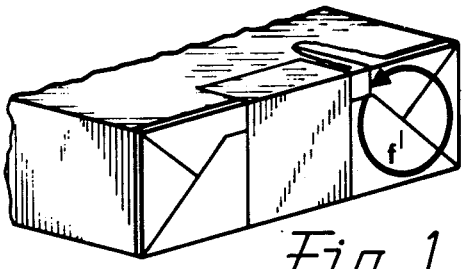
FIG. 1 shows in perspective part of a known soft or American type packet having the long ends of the inner wrapper over one of the two larger faces
Figure 2:
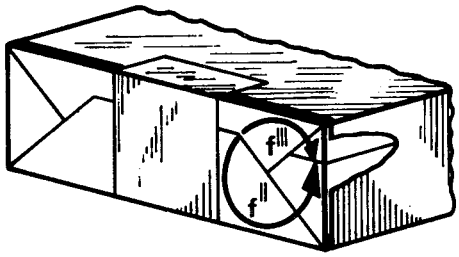
FIG. 2 shows in perspective part of a known soft or American type packet of cigarettes having the ends of the inner wrapper over one of the lesser or side faces
Figure 4:
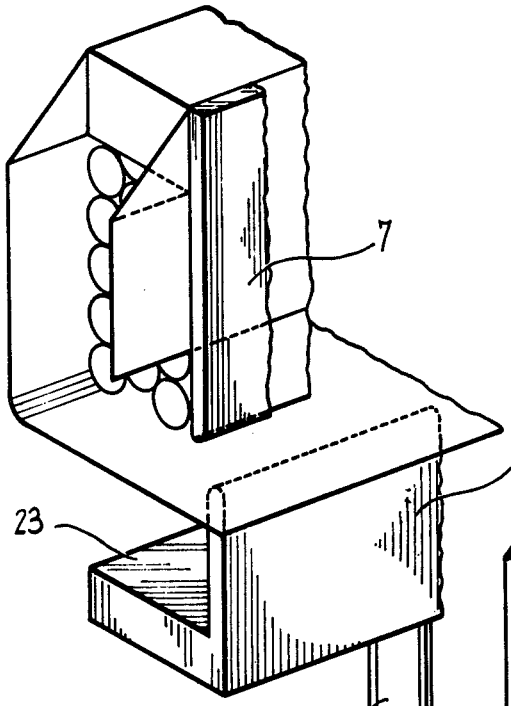
FIGS. 4 and 5 show also in perspective on a larger scale than FIG. 3 a detail of the device of the present invention in two different operating conditions.

In this position (see also FIGS. 4 and 5) first the tube wrap of length 8 is completed round the bundle of cigarettes through folding panel 13 on the side of the bundle already partly covered by panel 9.

This is done by element 22 comprising platelet 23 and plate 24 placed square to one another and mounted on spindle 25 having alternating movement radial to turning head 1 as indicated by arrow *f*4.

This element 22 in its forward course contacts panel 13 through plate 24 and makes it adhere progressively to the outer wall of plate 7 of compartment 3.

In accord with one of the main features of the present invention the plate 7 acts in this circumstance as a rigid element of reaction protecting the cigarettes and giving panel 13 a perfect fold.

Platelet 23 at the end of the run of element 22 comes to adhere to panel 12 blocking the bundle of cigarettes in the course of final folding operations completed in this position IV and here only briefly recalled since described in detail in the two patents cited above.

Figure 5:
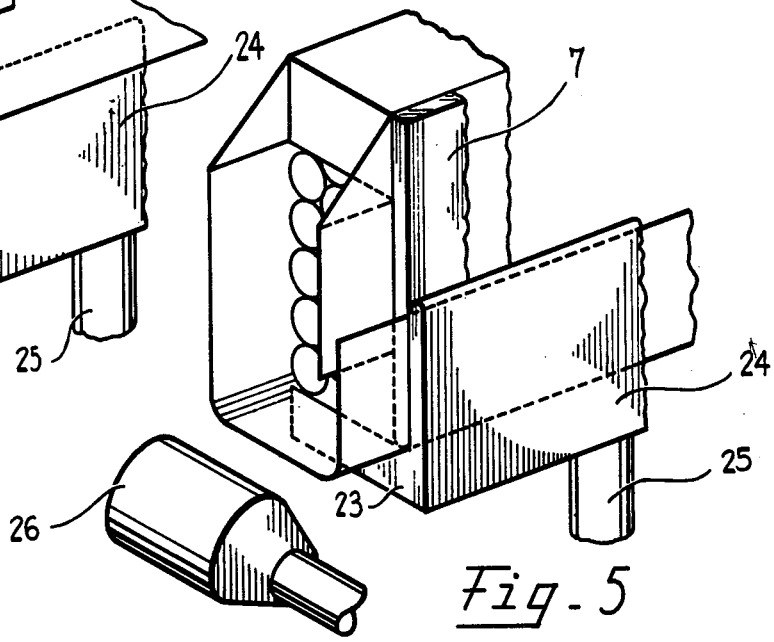

First the wings 12' are rebutted onto the head ends of the bundle of cigarettes through the oscillating folders 26 one only of which appears in FIG. 5.

After folders 26 disengage there follows still on the two head ends the folding operation of wings 9' and 13' partly over one another and lastly of the wings 11'.

This is done by oscillating folders not shown in the figures. Element 22 serves its twofold contrasting blocking function at this point, begins its return course away from panels 12 and 13 while turning head 1 resumes its rotary movement to a feed-out position V diametrically opposite feed-in position I. The bundle of cigarettes completely wrapped in the inner foil is kept correctly positioned in this phase in compartment 3 by fixed guide 21 mentioned above and by the two side guides 27 shaped with circular rims and adhering to the two opposite faces of the turning head. In position V the packet feed-out is performed by pusher 28 having alternating movement radial to turning head 1. This pusher as known contacts the packet on the inner side and propels it away from plate 7 towards a second turning head positioned to apply the outer wrapper or label as noted in the two patents cited above

I claim:

1. A device made for inner foil wrapping with the length's long ends over one of the larger faces of a bundle of cigarettes in very high speed soft packet cigarette packers, the device comprising a head or wheel turning at intervals and fitted with a number of radially positioned compartments equidistant from one another, each said compartment being capable of receiving a bundle of cigarettes for packeting laid long sides to the axis of rotation of said turning head or wheel; and a plurality of fixed and moving folder means in combination with said turning head or wheel for packeting operations with the length of foil, one of the said folder means being set at a tangent to the peripheral fascia of said turning head or wheel corresponding to a stay position occupied successively by said compartments of said turning head or wheel with alternating movement radial to said turning head or wheel, a wall of each compartment above that said one of said folder means with alternative movement in the sense of rotation of said turning head or wheel comprising a thin plate and said one folder means also having a thin plate facing said turning head or wheel so as during its forward movement to rebut the after ends of the length of foil onto the surface of the former plate external to the corresponding compartment, and wherein said folder means includes: a pair of radially oscillating arms with a platelet joined to an end of each said arm, said platelets contacting the two long ends of the outer side of the bundle of cigarettes; and a fixed guide concentric to said turning head.

2. A device made for inner foil wrapping with the length's long ends over one of the larger faces of a bundle of cigarettes in very high speed soft packet cigarette packers, the device comprising a head or wheel turning at intervals and fitted with a number of radially positioned compartments equidistant from one another, each said compartment being capable of receiving a bundle of cigarettes for packeting laid long sides to the axis of rotation of the said turning head or wheel; and a plurality of fixed and moving folder means in combination with said turning head or wheel for packeting operations with the length of foil, one of said moving folder means being tangent to the peripheral fascia of the said turning head or wheel corresponding to a stay position occupied successively by said compartments of said turning head or wheel and being connected to motion means for moving it in radial direction to said turning head or wheel, and in which said fixed folder means includes a thin plate defining a wall of each said compartment upstream with respect to the rotating direction of said turning head or wheel, and said one of said moving folder means connected to said motion means includes a thin plate turned towards said turning head or wheel so that during forward movement of said moving folder means this thin plate folds the last panel of the length of foil onto the outer wall of the compartment defined by said fixed folder means.

* * * * *